US008230968B2

(12) United States Patent
Jung et al.

(10) Patent No.: US 8,230,968 B2
(45) Date of Patent: Jul. 31, 2012

(54) SUCTION MUFFLER FOR HERMETIC COMPRESSOR

(75) Inventors: Min-Kyu Jung, Gyeongsangnam-do (KR); Hyo-Jae Lee, Gyeongsangnam-do (KR); Bok-Ann Park, Gyeongsangnam-do (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 13/125,559

(22) PCT Filed: Oct. 22, 2009

(86) PCT No.: PCT/KR2009/006118

§ 371 (c)(1),
(2), (4) Date: May 13, 2011

(87) PCT Pub. No.: WO2010/047543

PCT Pub. Date: Apr. 29, 2010

(65) Prior Publication Data

US 2011/0209941 A1 Sep. 1, 2011

(30) Foreign Application Priority Data

Oct. 22, 2008 (KR) ..... 10-2008-0103483

(51) Int. Cl.
*F02M 35/00* (2006.01)

(52) U.S. Cl. ..... 181/229; 181/212; 181/264; 181/271

(58) Field of Classification Search ..... 181/212, 181/229, 264, 271; 417/312
See application file for complete search history.

(56) References Cited

U.S. PATENT DOCUMENTS

| | | | | |
|---|---|---|---|---|
| 4,793,775 | A * | 12/1988 | Peruzzi | 417/312 |
| 5,216,985 | A * | 6/1993 | Brummer et al. | 123/184.56 |
| 5,749,342 | A * | 5/1998 | Chao | 123/184.56 |
| 7,306,438 | B2 * | 12/2007 | Kang et al. | 417/417 |
| 7,478,996 | B2 * | 1/2009 | Kang et al. | 417/312 |
| 7,686,594 | B2 * | 3/2010 | Iversen et al. | 417/312 |
| 2008/0219863 | A1 * | 9/2008 | Jung | 417/312 |

FOREIGN PATENT DOCUMENTS

| | | |
|---|---|---|
| JP | 60-022083 | 2/1985 |
| WO | WO 03/038280 | 5/2003 |

* cited by examiner

*Primary Examiner* — Forrest M Phillips
(74) *Attorney, Agent, or Firm* — McKenna Long & Aldridge LLP

(57) ABSTRACT

The present invention discloses a suction muffler for a hermetic compressor which reduces noise of refrigerant. A plate film operating as a kind of flow resistance is provided on a refrigerant suction passage in various shapes and specific positions. Therefore, the suction muffler can effectively reduce pressure pulsation transferred to the outside and guarantee flow efficiency, although the refrigerant is directly sucked thereinto.

15 Claims, 9 Drawing Sheets

【Figure 1】
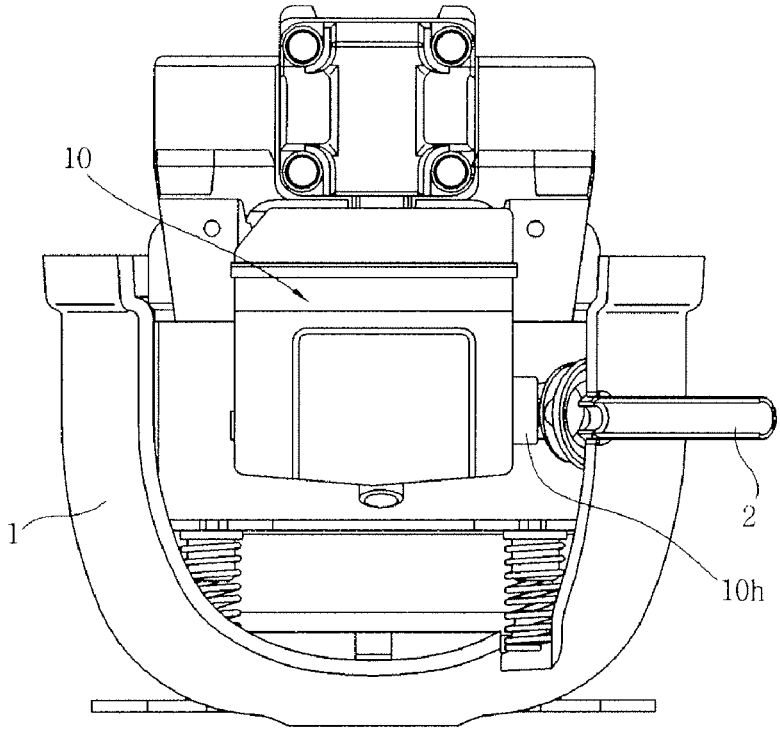
【Figure 2】
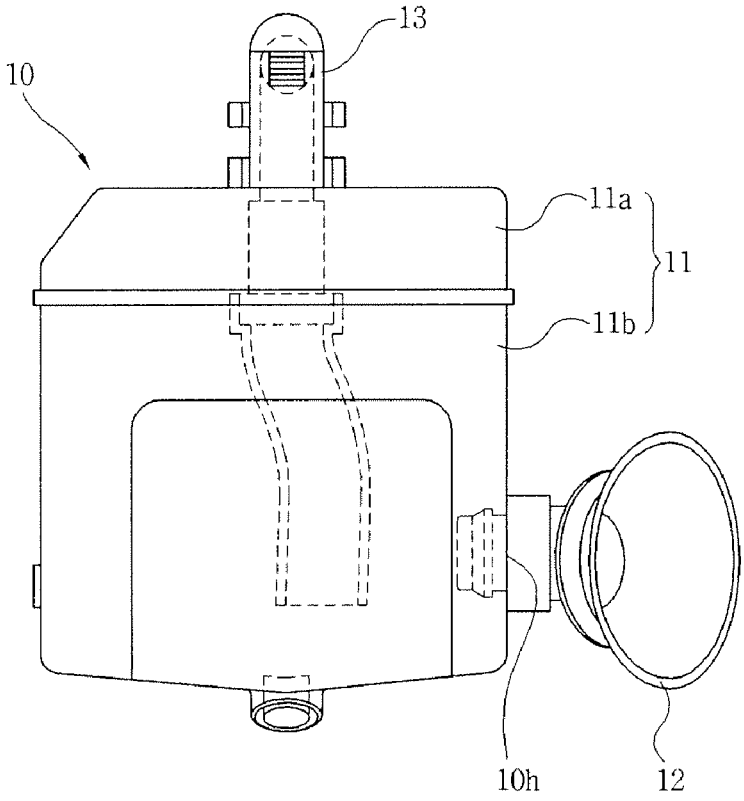

【Figure 3】
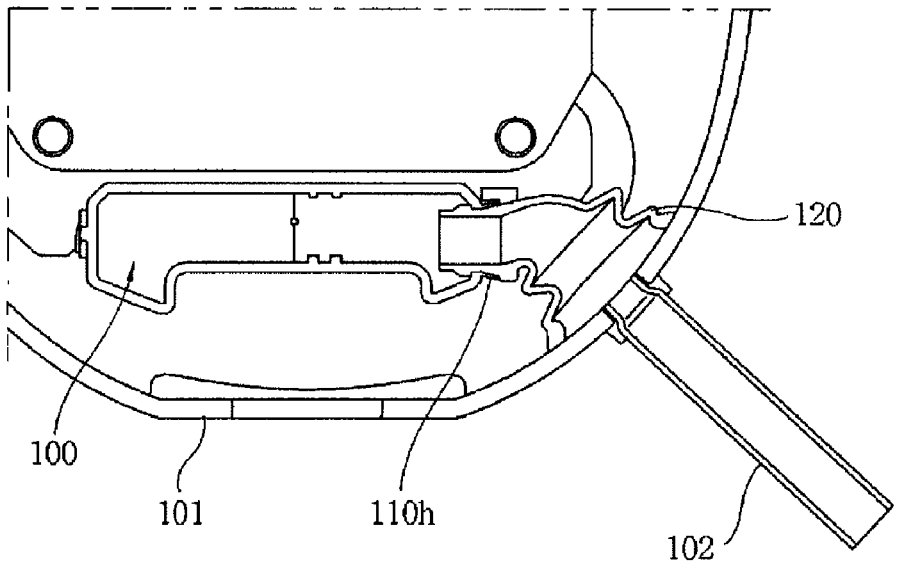
【Figure 4】
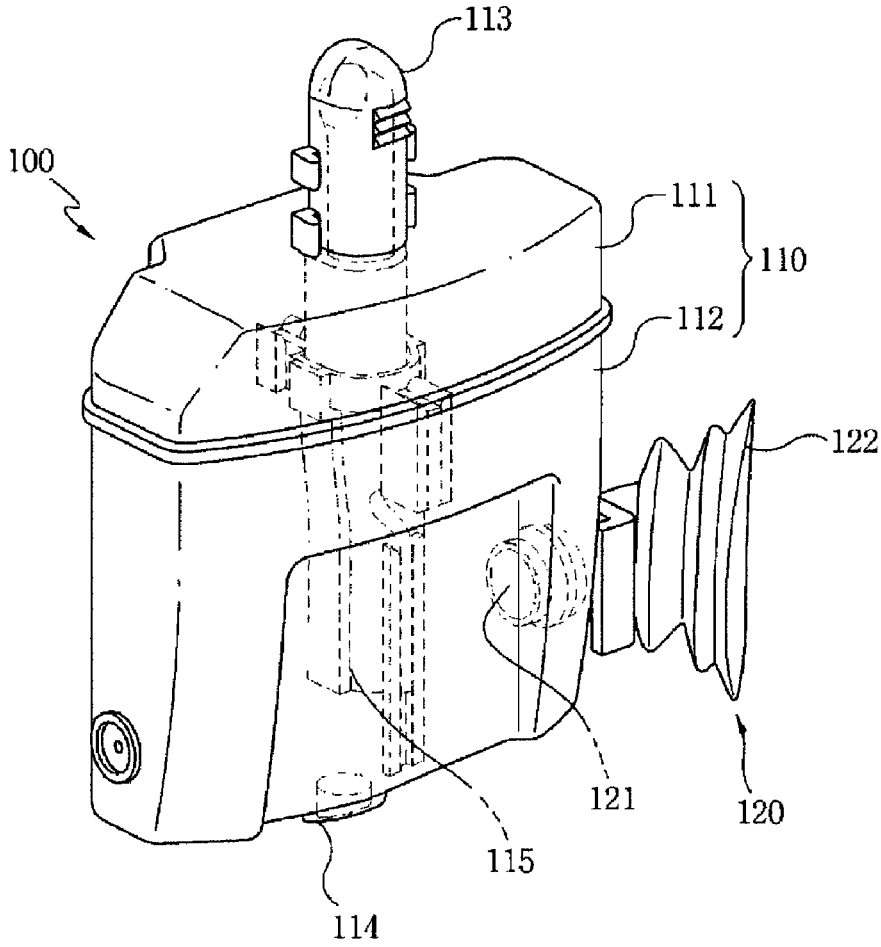

【Figure 5】
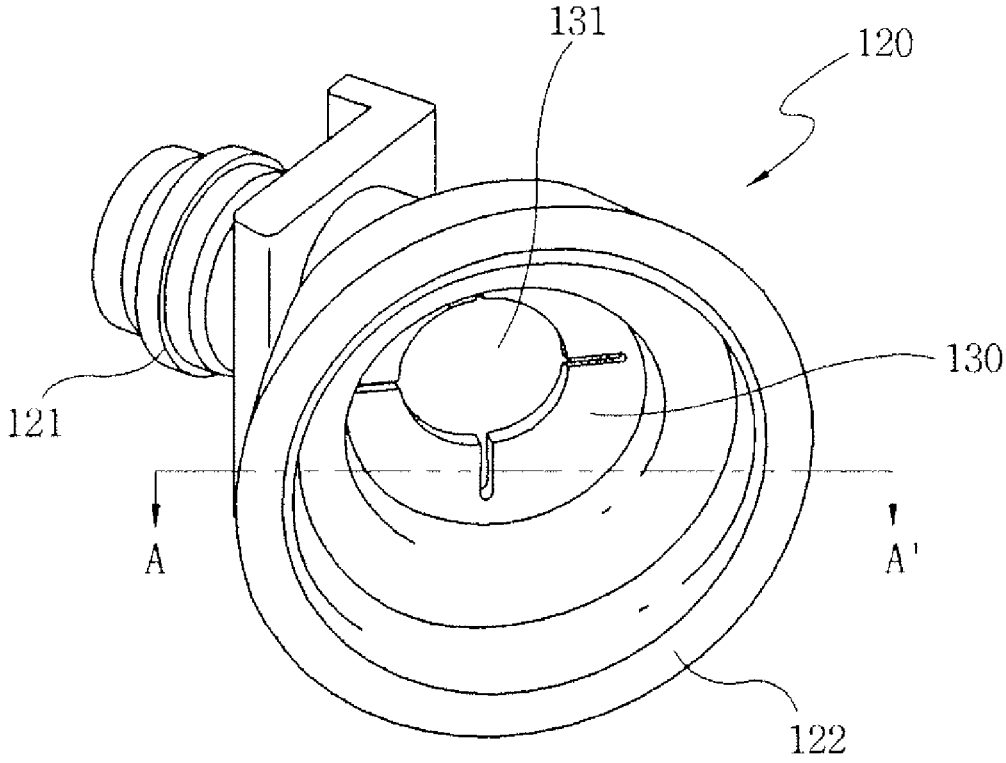
【Figure 6】
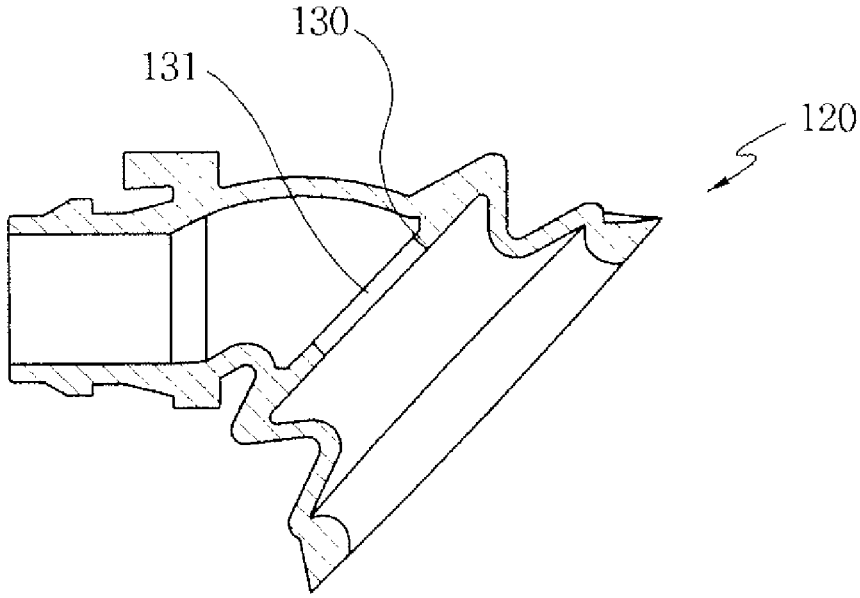

【Figure 7】
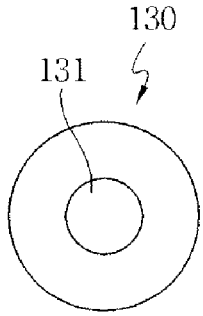
【Figure 8】
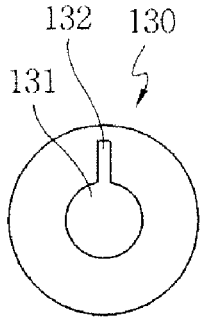
【Figure 9】
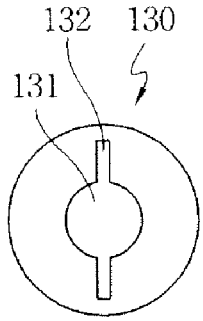
【Figure 10】
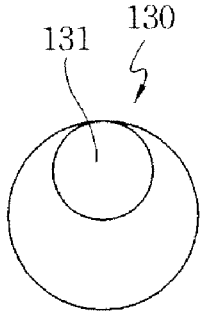

【Figure 11】
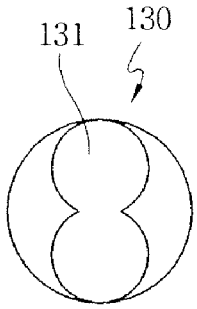
【Figure 12】
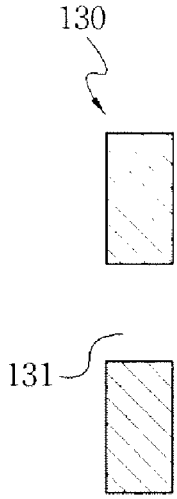
【Figure 13】
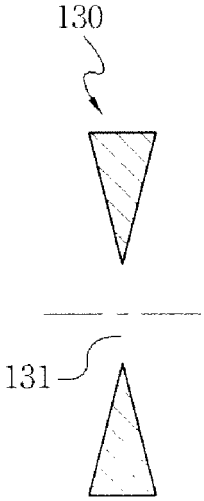

【Figure 14】
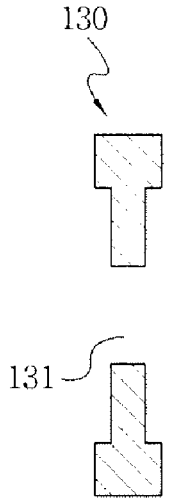
【Figure 15】
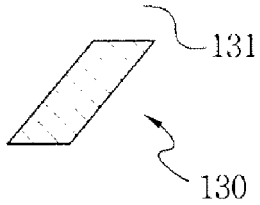
【Figure 16】
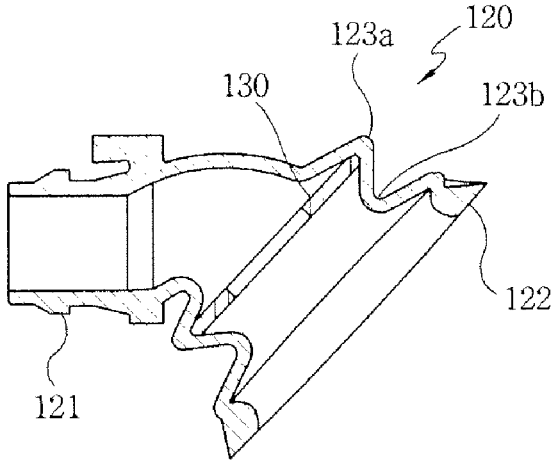

【Figure 17】
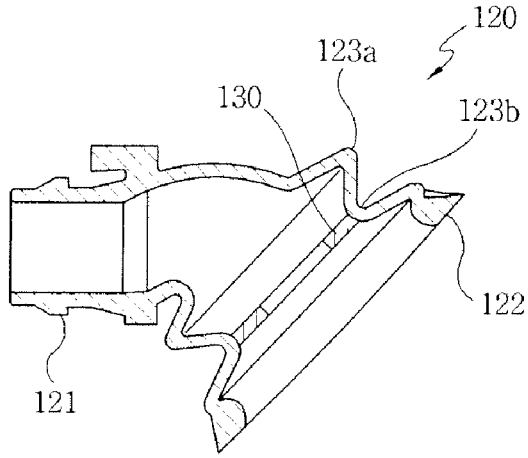
【Figure 18】
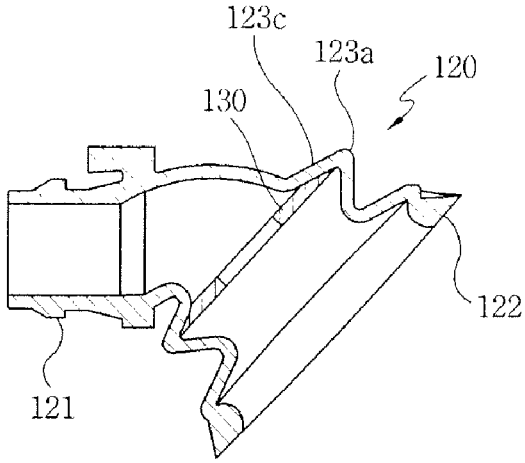
【Figure 19】
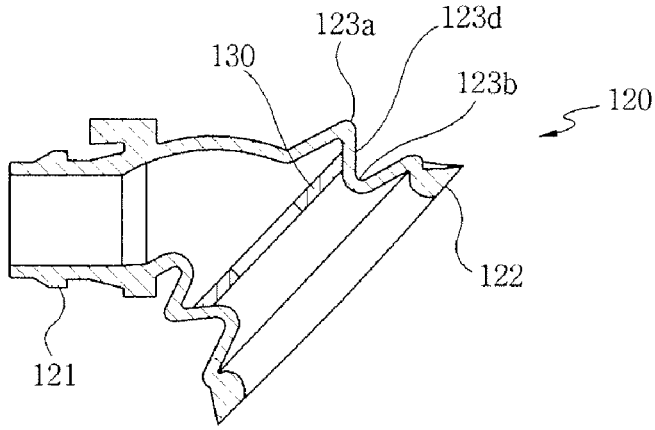

【Figure 20】
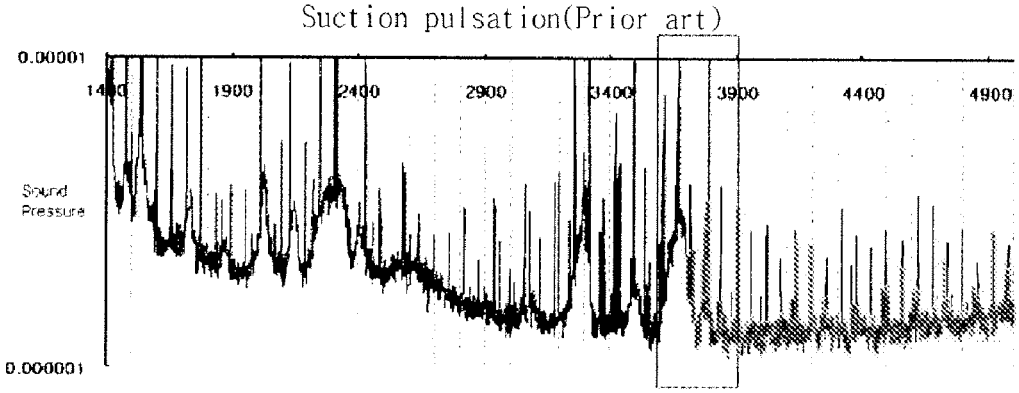
【Figure 21】
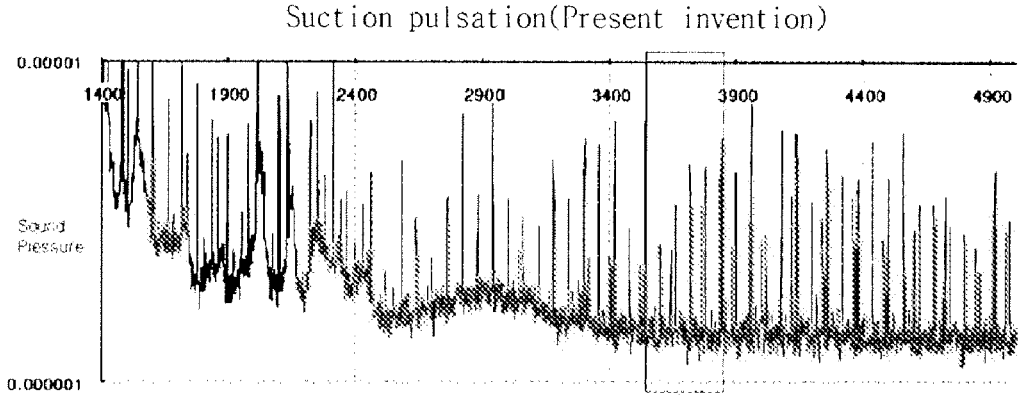

【Figure 22】
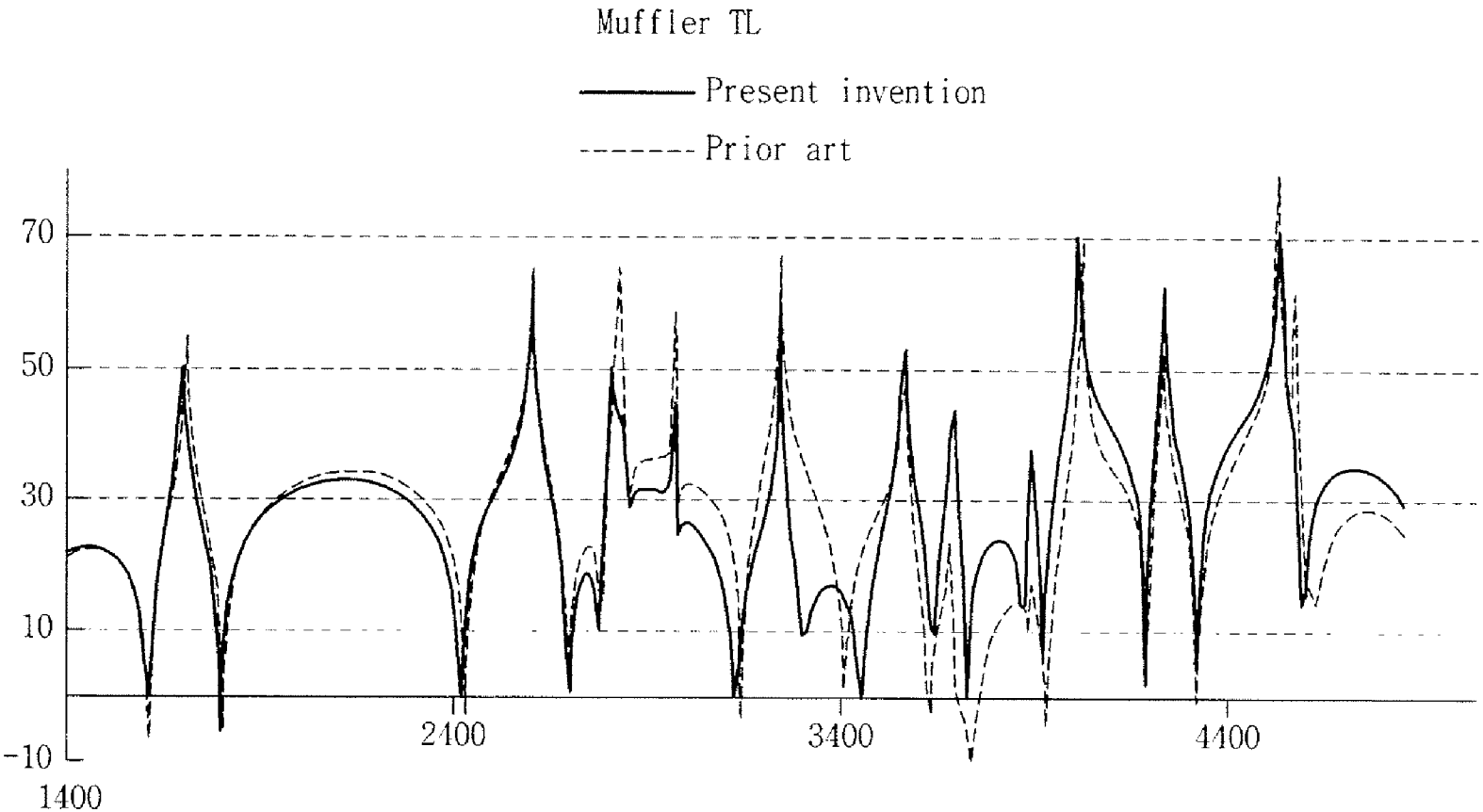

SUCTION MUFFLER FOR HERMETIC COMPRESSOR

This Application is a 35 U.S.C. §371 National Stage Entry of International Application No.: PCT/KR2009/006118, filed on Oct.22, 2009, which claims priority to Korean Patent Application No: 10-2008-0103483, filed on Oct. 22, 2008, both of which are hereby incorporated by reference in their entirety for all purposes as if fully set forth herein.

TECHNICAL FIELD

The present invention relates to a suction muffler for a hermetic compressor, and more particularly, to a suction muffler for a hermetic compressor which can effectively reduce pressure pulsation transferred to the outside and guarantee flow efficiency, although refrigerant is directly sucked thereinto.

BACKGROUND ART

In general, a reciprocating compressor uses a driving motor to reciprocate a piston in a cylinder and sucks, compresses and discharges refrigerant by the reciprocating movement.

FIG. 1 is a view of a part of a conventional reciprocating compressor. As illustrated in FIG. 1, refrigerant is sucked from a suction pipe 2 outside a shell 1 into a suction muffler 10 inside the shell 1. After its vibration and noise are reduced, the refrigerant is transferred to and compressed in a compression mechanism (not shown) of the compressor.

The compressors are divided into an indirect-suction type and a direct suction type according to a suction passage of refrigerant, which is determined by a connection type of the suction pipe 2 and the suction muffler 10.

The indirect-suction type compressor is configured such that a predetermined spacing is defined between the suction pipe 2 and the suction muffler 10. A front end portion of the suction pipe 2 inside the shell 1 is not connected directly to the suction muffler 10 but positioned at the front of an inlet port 10*h* of the suction muffler 10. Therefore, the indirect-suction type compressor improves vibration and noise performance because wave energy produced by the behavior of a suction valve (not shown) is reduced through the inner volume of the shell 1 so as not to affect the suction pipe 2. However, it degrades cooling capability and efficiency because the sucked refrigerant is influenced by the compressed refrigerant.

Accordingly, recently, the direct-suction type compressor has been widely used to overcome the refrigerant insulation problem of the indirect-suction type compressor. That is, the direct-suction type compressor is configured such that the suction pipe 2 and the suction muffler 10 are connected directly to each other, which not only prevents heat transfer between the heated refrigerant and the sucked refrigerant inside the shell 1 but also prevents re-suction. Therefore, the direct-suction type compressor can increase the specific volume of the sucked refrigerant and thus improve freezing efficiency.

FIG. 2 is a view of an example of the suction muffler for the conventional reciprocating compressor.

As illustrated in FIGS. 1 and 2, the suction muffler 10 includes a main body 11 defining a space for reducing noise, and a connection member 12 for guiding refrigerant to be sucked into the main body 11.

The main body 11 is generally formed by coupling an upper main body 11*a* to a lower main body 11*b*. A discharge portion 13 is provided at the upper side of the upper main body 11*a*, the inlet port 10*h* through which the refrigerant is sucked is formed at one side of the lower main body 11*b*, and the connection member 12 is connected to the inlet port 10*h*.

A part of the connection member 12 connected to the inlet port 10*h* has a smaller diameter than the opposite part thereof to easily transfer the refrigerant into the compressor. That is, the connection member 12 is generally formed in the shape of a funnel. In addition, the connection member 12 is mostly made of an elastic-deformable material and installed inside the shell 1 to connect the suction pipe 2 outside the shell 1 to the main body 11 inside the shell 1.

The direct-suction type compressor, in which the suction muffler 10 is connected directly to the suction pipe 2, cannot secure a buffering space for reducing wave energy produced by vibration generated by the compression mechanism or the behavior of the suction valve. Therefore, the resulting shock is transferred to the suction pipe 2 as it is.

As compared with the indirect-suction type compressor, the direct-suction type compressor is advantageous in terms of freezing efficiency but disadvantageous in terms of noise. That is, when this compressor is applied to a product such as a refrigerator, pressure pulsation transferred through the suction pipe of the compressor and vibration and shock caused by the opening and closing of the suction valve are transferred to the entire product and operated as a noise source.

Moreover, a refrigerant suction passage may be narrowed to reduce noise in the compressor. This serves as a flow resistance reducing flow efficiency, and thus degrades efficiency of the entire product using the compressor.

DISCLOSURE

Technical Problem

The present invention has been made in an effort to solve the above-described problems of the prior art, and an object of the present invention is to provide a suction muffler for a hermetic compressor which can effectively reduce pressure pulsation and vibration and noise caused by the opening and closing of a valve.

Another object of the present invention is to provide a suction muffler for a hermetic compressor which can reduce noise and guarantee flow efficiency at the same time.

Technical Solution

According to an aspect of the present invention for achieving the above objects, there is provided a suction muffler for a hermetic compressor connected to a suction pipe provided outside a hermetic shell, the suction muffler, including: a main body which is a temporary storage space of refrigerant, the main body being installed inside the shell and provided with an inlet port through which the refrigerant is sucked and a discharge portion for discharging the refrigerant; a connection member positioned inside the shell to allow the inlet port of the main body and the suction pipe to communicate with each other; and at least one plate film provided inside the connection member and operated as a flow resistance in the inner space of the connection member. Therefore, it is possible to reduce vibration and noise transferred to the suction pipe in the direct-suction type compressor.

In addition, the connection member is formed in the shape of a bellows having convex and concave parts such that an inner diameter thereof increases toward the suction pipe. Thus, the connection member can be provided as a passage which can be flexibly moved during the vibration.

Moreover, one end of the connection member is closely attached to an inner surface of the shell communicating with the suction pipe, and the other end thereof is inserted into the inlet port of the main body. Accordingly, it is possible to prevent the refrigerant from being leaked between the main body and the connection member.

Further, the plate film protrudes from an inner circumferential surface of the connection member to define a predetermined opening portion through which the refrigerant flows and is bent by the flow of the refrigerant. It is thus possible to reduce the flow resistance and guarantee flow efficiency.

Furthermore, the thickness of the plate film is smaller than that of the connection member. This guarantees flexibility of the plate film.

Still furthermore, the plate film protrudes from an inner circumferential surface of the connection member to define a predetermined opening portion through which the refrigerant flows and is made of a soft material to be bent by the flow of the refrigerant. Therefore, the plate film can be integrally formed with the connection member.

Still furthermore, the plate film protrudes from an inner circumferential surface of the connection member to define a predetermined opening portion through which the refrigerant flows and is provided with a cutting portion to be bent by the flow of the refrigerant. This guarantees flexibility of the plate film.

Still furthermore, the plate film is formed of two or more plate film pieces, the cutting portion thereof being formed in the diameter direction.

Still furthermore, the thickness of the plate film increases toward the inner circumferential surface of the connection member. Accordingly, deformation can be more generated in the opening portion of the plate film, which reduces the flow resistance.

Still furthermore, the sectional shape of the plate film is a wedge.

Still furthermore, the sectional shape of the plate film has a stepped part.

Still furthermore, the plate film is provided on a slant face connecting the convex and concave parts of the inner circumferential surface of the connection member. It is thus possible to prevent the movement of the connection member from being interrupted by the plate film and to minimize damage to the plate film.

Still furthermore, the plate film protrudes from an inner circumferential surface of the connection member to define a predetermined opening portion through which the refrigerant flows, and the width of the opening portion of the plate film is the same as the inner width of a coupling portion of the connection member coupled to the inlet port of the main body. Therefore, it is possible to effectively reduce the pressure wave transferred to the outside.

Advantageous Effects

In the suction muffler for the hermetic compressor according to the present invention, since the plate film is provided on the refrigerant suction passage, although pressure pulsation and vibration and noise caused by the opening and closing of the valve are generated in the compressor, they can be effectively reduced in the noise space defined by the plate film on the refrigerant suction passage.

Moreover, in the suction muffler for the hermetic compressor according to the present invention, when the plate film is provided on the refrigerant suction passage to reduce vibration and noise, it is formed in specific shape and position to be flexibly moved. It is thus possible to reduce the flow resistance of the sucked refrigerant and thus to guarantee flow efficiency.

DESCRIPTION OF DRAWINGS

FIG. 1 is a view of a part of a conventional reciprocating compressor;

FIG. 2 is a view of an example of a suction muffler for the conventional reciprocating compressor.

FIG. 3 is a view of an example of installing a suction muffler in a hermetic compressor according to the present invention;

FIG. 4 is a detailed view of the suction muffler of FIG. 3 according to the present invention;

FIG. 5 is a perspective view of an example of a connection member which is a major element of the present invention;

FIG. 6 is a sectional view of the connection member cut along line A-A' of FIG. 5;

FIGS. 7 to 11 are front views of various embodiments of a plate film;

FIGS. 12 to 15 are sectional views of various embodiments of the plate film;

FIGS. 16 to 19 are sectional views of various installation positions of the plate film;

FIG. 20 is a graph of suction pulsation in the compressor provided with the conventional suction muffler;

FIG. 21 is a graph of suction pulsation in the compressor provided with the suction muffler of the present invention; and FIG. 22 is a graph of transmission losses of the conventional suction muffler and the suction muffler of the present invention.

MODE FOR INVENTION

FIG. 3 is a view of an example of installing a suction muffler in a hermetic compressor according to the present invention, and FIG. 4 is a detailed view of the suction muffler of FIG. 3 according to the present invention.

As illustrated in FIGS. 3 and 4, the suction muffler 100 includes a main body 110 installed in an inner space of a shell 101 of the compressor and defining a noise space for reducing noise generated in the compressor, and a connection member 120 for allowing a suction pipe 102 to communicate with the main body 110, the suction pipe 102 being provided outside the shell 101 to communicate with the inner space thereof.

The main body 110 is formed by coupling an upper main body 111 and a lower main body 112 to each other. A discharge portion 113 for discharging refrigerant is provided at the upper side of the upper main body 111, and an inlet port **110*h* through which the refrigerant is sucked and an oil drain pipe 114 for separating oil from the refrigerant and discharging the oil are provided at one side of the lower main body 112. When the oil for cooling and lubricating the hermetic compressor is sucked through the inlet port 110*h* with the refrigerant, passed through the main body 110, discharged to the discharge portion 113, and circulated in a freezing cycle, it may degrade refrigerant efficiency. In order to solve this problem, the oil drain pipe 114 provided in the main body 110 of the suction muffler 100 serves to separate the oil from the refrigerant and discharge the oil to the outside. Moreover, an inner pipe 115 extending from the discharge portion 113 to the inside of the main body 110 is provided to transfer the refrigerant sucked through the inlet port 110*h* to the discharge portion 113. Preferably, the inner pipe 115 is bent so that the refrigerant can be smoothly introduced thereinto. The refrigerant is introduced into the inner pipe 115, rotating in the main body 110. As the inner pipe 115 is bent, the refrigerant can flow into the inner pipe 115** maintaining the rotational force, and thus more smoothly flow.

The connection member 120 is installed to allow the inlet port 110*h* of the main body 110 and the suction pipe 102 on the shell 101 side to communicate with each other. Here, the connection member 120 includes a coupling portion 121 inserted into and coupled to the inlet port 110*h* of the main body, and an attachment portion 122 closely attached to an inner surface of the shell 101. A connection part between the coupling portion 121 and the attachment portion 122 is curved in consideration of a narrow installation space inside the shell 101.

The coupling portion 121 of the connection member 120 is inserted into and coupled to the inlet port 110*h* of the main body 110. Preferably, if the connection member 120 is made of a soft material having elasticity, the outer diameter of the coupling portion 121 of the connection member 120 may be press-fit into the inlet port 110*h* of the main body 110. More preferably, if the connection member 120 is made of a soft material having elasticity and its coupling portion 121 has a stepped part, when the coupling portion 121 of the connection member 120 is fitted into the inlet port 110*h* of the main body 110, the stepped part can be fixedly coupled to the corresponding stepped part formed at the main body 110.

The attachment portion 122 of the connection member 120 is formed in the shape of a funnel such that its inner diameter increases toward the suction pipe 102. Preferably, the attachment portion 122 of the connection member 120 has a sufficiently larger inner diameter than the suction pipe 102 so as not to separate from a predetermined communication part of the inner surface of the shell 101 communicating with the suction pipe 102 although vibration is generated in the compressor. More specifically, an end of the attachment portion 122 of the connection member 120 is closely attached to the inner surface of the shell 101, enclosing the part communicating with the suction pipe 102. Since the connection member 120 is not mechanically fixed and coupled to the shell 101, it can be moved along the inner surface of the shell 101 by a predetermined distance during the vibration of the compressor. Preferably, the inner diameter of the attachment portion 122 of the connection member 120 is determined to sufficiently enclose the part of the inner surface of the shell 101 communicating with the suction pipe 102 in consideration of the movement distance during the vibration.

In addition, the attachment portion 122 of the connection member 120 is elastically supported by an elastic force operating in a normal-line direction of the inner surface of the shell 101. Therefore, the attachment portion 122 of the connection member 120 is pressed on the inner surface of the shell 101 communicating with the suction pipe 102 by the elastic force.

Preferably, the end of the attachment portion 122 of the connection member 120 is flat to prevent the refrigerant from being leaked through the attached part. Additionally, the end of the attachment portion 122 of the connection member 120 may be made of a softer material than the other parts or may have a sealing agent adhered thereto.

Preferably, a part of the connection member 120 between the coupling portion 121 and the attachment portion 122 may be formed in the shape of a bellows having convex and concave parts. More precisely, the connection member 120 is formed in the shape of a bellows-type funnel in which convex and concave parts are sequentially arranged. Accordingly, the connection member 120 provided with the convex and concave parts can flexibly cope with left-right vibration. There are advantages of providing a smooth path of the refrigerant introduced into the connection member 120 and guaranteeing durability of the connection member 120. Further, the connection member 120 made of a soft material and provided with the convex and concave parts is not much influenced by the shape of the inner surface of the shell 101, so that it can be applied to various shapes of the inner surface of the shell 101 and various positions of the suction muffler 100 and enhance the attachment force. However, the direct-suction type compressor generates noise because pressure pulsation and valve slap noise generated in a suction valve are transferred to the suction pipe as explained in the prior art. It is thus preferable to decrease the passage area to suppress the pressure wave. For this purpose, it is possible to decrease the inner diameter of the coupling portion 121 of the connection member 120. However, in this case, flow efficiency may be degraded due to increase of the flow resistance. Therefore, a predetermined plate film 130 may be provided inside the connection member 120 to decrease the passage area to suppress the pressure wave and to minimize the flow resistance at the same time.

FIG. 5 is a perspective view of an example of the connection member which is a major element of the present invention, and FIG. 6 is a sectional view of the connection member cut along line A-A' of FIG. 5.

As illustrated in FIGS. 5 and 6, the plate film 130 may be integrally formed with the connection member 120 or separately formed and coupled to the inside of the connection member 120. If the plate film 130 is integrally formed with the connection member 120, it may be manufactured using a single injection.

The plate film 130 is provided in the connection member 120 to decrease the passage area to reduce pressure pulsation and valve slap noise. Accordingly, the plate film 130 is generally formed in the shape of a thin disk and has an opening portion 131 formed therein so that the refrigerant can flow therethrough. The inner diameter of the opening portion 131 is determined to have a smaller passage area than that of the other parts of the connection member 120.

Meanwhile, when the passage area is sharply reduced, there may be problems such as vibration and low flow efficiency caused by the flow resistance. To solve these problems, it is necessary to provide flexibility to the plate film 130. Hereinafter, the structure of the plate film 130 will be described in more detail with reference to the accompanying drawings.

FIGS. 7 to 11 are front views of various embodiments of the plate film. The plate film 130 may be provided with an opening portion 131 and a cutting portion 132 of various shapes to have flexibility.

FIG. 7 illustrates the shape of a plate film 130 which can be generally easily arranged. An opening portion 131 is formed in the center of the plate film 130 to define a passage. In this case, preferably, the plate film 130 is made of a flexible material to solve problems in flow resistance and efficiency. Therefore, the opening portion 131 side of the plate film 130 may be bent according to the flow, thereby suppressing the pressure wave of the compressor and reducing the flow resistance. More preferably, the thickness of the plate film 130 is smaller than that of the connection member 120. The thinner the plate film 130, the more flexible it is. As such, flow efficiency can be more improved. If the plate film 130 is thin, it may be made of a metal material. Preferably, the thickness of the plate film 130 is smaller than or equal to 3 mm.

Referring to FIGS. 8 and 9, a plate film 130 has a cutting portion 132 formed therein, and thus includes one or more plate film pieces. The cutting portion 132 is connected to an opening portion 131 such that deformation can be more generated around the cutting portion 132, which leads to high flexibility and high flow efficiency. Referring to FIGS. 10 and 11, an opening portion 131 of a plate film 130 is eccentric with respect to the center of the plate film 130. The shape and position of the opening portion 131 are not limited to the embodiments of the present invention, but are modified in various ways in consideration of the flow and the flow resistance. In the meantime, preferably, the area of the opening portion 131 of the plate film 130 is substantially identical to the inner width of the inlet port side (110*h*; refer to FIG. 3). However, the area of the opening portion 131 may be slightly increased or decreased with respect to the inner width of the passage of the inlet port side (110*h*; refer to FIG. 3) in consideration of the flow and the resistance. If a plurality of opening portions 131 are provided, the area of the opening portion 131 indicates the total area of the opening portions 131.

FIGS. 12 to 15 are sectional views of various embodiments of the plate film. The plate film 130 may be formed in various sectional shapes to have flexibility.

FIG. 12 illustrates an embodiment in which the sectional shape of a plate film 130 has uniform thickness. In this case, as described above, the plate film 130 should be made of a soft material or have a small thickness. The sectional thickness of the plate film 130 is preferably smaller than the thickness of the connection member 120, and more preferably smaller than or equal to 3 mm.

FIGS. 13 and 14 illustrate embodiments in which the sectional thickness of a plate film 130 decreases toward the center of the plate film 130, i.e., the center of an opening portion 131. Since deformation caused by the flow is more generated in the thin part of the plate film 130, the flow resistance can be reduced around the opening portion 131 of the plate film 130 through which the refrigerant flows. FIG. 13 illustrates an embodiment in which the section has slant faces to form a wedge shape, and FIG. 14 illustrates an embodiment in which the section has stepped parts such that its thickness decreases toward the center of the opening portion 131.

Meanwhile, FIG. 15 illustrates an embodiment in which an opening portion 131 is provided to be eccentric with respect to the center of a plate film 130, i.e., the plate film 130 is arranged to be inclined in the diameter direction. Therefore, the plate film 130 can be flexible with respect to the flow in the direction of the opening portion 131.

FIGS. 16 to 19 are sectional views of various installation positions of the plate film.

FIG. 16 illustrates a case where a plate film 130 is arranged along the inner diameter of a convex part 123*a* of a bellows-shaped connection member 120, and FIG. 17 illustrates a case where a plate film 130 is arranged along the inner diameter of a concave part 123*b* of a bellows-shaped connection member 120.

If the connection member 120 is formed in the shape of a bellows in which the convex parts 123*a* and the concave parts 123*b* are repeatedly arranged, deformation caused by the arrangement process of the connection member 120 or the vibration is the greatest in the convex parts 123*a* and the concave parts 123*b*. Accordingly, as illustrated in FIGS. 16 and 17, if the plate film 130 is formed along the inner diameter of the convex part 123*a* or the concave part 123*b* of the connection member 120, it may interrupt the natural movement of the connection member 120. Surely, a coupling part between the plate film 130 and the connection member 120 may be brought into contact with the shell 101 (refer to FIG. 3) or the main body 110 (refer to FIG. 3), and in a worse case, the plate film 130 may damage the convex part 123*a* or the concave part 123*b* of the connection member 120.

Therefore, as illustrated in FIGS. 18 and 19, it is preferable to arrange a plate film 130 in a part other than a convex part 123*a* and a concave part 123*b* on an inner circumferential surface of a connection member 120. In more detail, the outer diameter of the plate film 130 is formed on the inner diameter of a slant face 123*c* or 123*d* adjacent to the convex part 123*a* or the concave part 123*b* of the connection member 120.

In the meantime, the plate film 130 may be formed adjacent to a coupling portion 121 or an attachment portion 122 of the connection member 120 in consideration of a flow resistance, noise reduction, or the like. Moreover, one or plural plate films 130 may be arranged as needed.

FIGS. 20 and 21 are graphs of suction pulsation in the compressor provided with the conventional suction muffler and the compressor provided with the suction muffler of the present invention, respectively.

In the graphs of FIGS. 20 and 21, the axis of ordinates represents a log-scale size of a sound pressure and the axis of abscissas represents a frequency. The smaller the suction pulsation, the better it is.

In 3500 Hz to 3800 Hz which were frequencies mostly generated in the compressor, the suction muffler provided with the plate film according to the present invention reduced vibration and noise much more than the conventional one FIG. 22 is a graph of transmission losses of the conventional suction muffler and the suction muffler of the present invention.

In the graph of FIG. 22, the axis of ordinates represents a log-scale size of a sound pressure and the axis of abscissas represents a frequency. The larger the transmission loss, the better it is. That is, it is preferable when the transmission loss is located in the upper part (positive number) of the graph.

The transmission loss of the conventional suction muffler is indicated by a dotted line and the transmission loss of the suction muffler of the present invention is indicated by a solid line. Also in 3500 Hz to 3800 Hz which were frequencies of the compressor, the suction muffler provided with the plate film according to the present invention had a smaller transmission loss than the conventional suction muffler in some section, but considerably improved the transmission loss in the other sections.

The present invention has been described in connection with the exemplary embodiments and the accompanying drawings. However, the scope of the present invention is not limited thereto but is defined by the appended claims.

The invention claimed is:

1. A suction muffler for a hermetic compressor connected to a suction pipe provided outside a hermetic shell, the suction muffler, comprising:

a main body which is a temporary storage space of refrigerant, the main body being installed inside the shell and provided with an inlet port through which the refrigerant is sucked and a discharge portion for discharging the refrigerant;

a connection member positioned inside the shell to allow the inlet port of the main body and the suction pipe to communicate with each other; and at least one baffle provided inside the connection member and operated as a flow resistance in the inner space of the connection member, wherein the thickness of the baffle increases toward the inner circumferential surface of the connection member.

2. The suction muffler of claim 1, wherein the connection member is formed in the shape of a bellows having convex and concave parts such that an inner diameter thereof increases toward the suction pipe.

3. The suction muffler of either claim 1 or 2, wherein one end of the connection member is closely attached to an inner surface of the shell communicating with the suction pipe, and the other end thereof is inserted into the inlet port of the main body.

4. The suction muffler of either claim 1 or 2, wherein the at least one baffle protrudes from an inner circumferential surface of the connection member to define a predetermined opening portion through which the refrigerant flows and is bent by the flow of the refrigerant.

5. The suction muffler of claim 4, wherein the thickness of the at least one baffle is smaller than that of the connection member.

6. The suction muffler of either claim 1 or 2, wherein the at least one baffle protrudes from an inner circumferential surface of the connection member to define a predetermined opening portion through which the refrigerant flows and is made of a soft material to be bent by the flow of the refrigerant.

7. The suction muffler of either claim 1 or 2, wherein the at least one baffle protrudes from an inner circumferential surface of the connection member to define a predetermined opening portion through which the refrigerant flows and is provided with a cutting portion to be bent by the flow of the refrigerant.

8. The suction muffler of claim 7, wherein the at least one baffle is formed of two or more baffle pieces, the cutting portion thereof being formed in the radial direction.

9. The suction muffler of claim 1, wherein the sectional shape of the at least one baffle is a wedge.

10. The suction muffler of claim 1, wherein the sectional shape of the at least one baffle has a stepped part.

11. The suction muffler of claim 2, wherein the plate film is provided on a slant face connecting the convex and concave parts of the inner circumferential surface of the connection member.

12. The suction muffler of either claim 1 or 2, wherein the at least one baffle protrudes from an inner circumferential surface of the connection member to define a predetermined opening portion through which the refrigerant flows, and the width of the opening portion of the plate film is the same as the inner width of a coupling portion of the connection member coupled to the inlet port of the main body.

13. A suction muffler for a hermetic compressor connected to a suction pipe provided outside a hermetic shell, the suction muffler, comprising:

a main body which is a temporary storage space of refrigerant, the main body being installed inside the shell and provided with an inlet port through which the refrigerant is sucked and a discharge portion for discharging the refrigerant;

a connection member positioned inside the shell to allow the inlet port of the main body and the suction pipe to communicate with each other; and at least one baffle provided inside the connection member and operated as a flow resistance in the inner space of the connection member, wherein the connection member is formed in the shape of a bellows having convex and concave parts such that an inner diameter thereof increases toward the suction pipe, and wherein the thickness of the at least one baffle increases toward the inner circumferential surface of the connection member.

14. The suction muffler of claim 13, wherein the sectional shape of the at least one baffle is a wedge.

15. The suction muffler of claim 13, wherein the sectional shape of the at least one baffle has a stepped part.

* * * * *